US005596930A

United States Patent [19]

Keller et al.

[11] Patent Number: 5,596,930

[45] Date of Patent: Jan. 28, 1997

[54] PROCESS AND DEVICE FOR MOISTENING A MOVING PRINTED THEN THERMALLY DRIED WEB OF MATERIAL

[75] Inventors: Alfred Keller, Leinfelden-Echterdingen; Günther Cernea, Steinenbronn, both of Germany

[73] Assignee: Weitmann & Konrad GmbH & Co., Leinfelden-Echterdingen, Germany

[21] Appl. No.: 387,822

[22] PCT Filed: Aug. 7, 1993

[86] PCT No.: PCT/DE93/00715

§ 371 Date: Feb. 16, 1995

§ 102(e) Date: Feb. 16, 1995

[87] PCT Pub. No.: WO94/04364

PCT Pub. Date: Mar. 3, 1994

[30] Foreign Application Priority Data

Aug. 17, 1992 [DE] Germany ..... 42 27 136.3

[51] Int. Cl.[6] ..... B41M 7/00

[52] U.S. Cl. ..... 101/483; 101/147

[58] Field of Search ..... 101/483, 148, 101/147, 488, 487

[56] References Cited

U.S. PATENT DOCUMENTS

| | | | |
|---|---|---|---|
| 3,066,046 | 11/1962 | Walton | 117/111 |
| 3,168,037 | 2/1965 | Dahlgren | 101/148 |
| 3,198,199 | 8/1965 | Schultz | 134/122 |
| 3,647,525 | 3/1972 | Dahlgren | 117/111 |
| 4,092,440 | 5/1978 | Wöhr et al. | 427/33 |
| 4,219,864 | 8/1980 | Grünenfelder et al. | 361/228 |

FOREIGN PATENT DOCUMENTS

| | | |
|---|---|---|
| 668206 | 12/1965 | Belgium . |
| 2058667 | 5/1972 | Germany . |
| 86339567 | 6/1988 | Germany . |
| 3535800 | 4/1989 | Germany . |
| 3900660 | 7/1990 | Germany . |
| 4021296 | 1/1992 | Germany . |
| 467159 | 2/1969 | Switzerland . |

*Primary Examiner*—Edgar S. Burr
*Assistant Examiner*—Anthony H. Nguyen
*Attorney, Agent, or Firm*—Dick and Harris

[57] ABSTRACT

A process and device are disclosed for moistening a moving web of material (10), in particular for moistening again a printed then dried printed material. As soon as possible after the thermal drying process is concluded, preferably in the area of the cooling cylinders, a moistening agent is pressed on one or both sides of the web of material (10) by an applicator (12) by means of a smooth cylinder (15), against a guiding element (11).

34 Claims, 3 Drawing Sheets

PROCESS AND DEVICE FOR MOISTENING A MOVING PRINTED THEN THERMALLY DRIED WEB OF MATERIAL

This invention concerns a process and a device for moistening a moving web of printed and thermally dried material according to the generic portion of patent claims 1 and 13.

In processing flat materials, especially webs of material, it is often necessary to moisten the material that is being processed before performing another processing step. Remoistening is especially necessary when processing printed and then thermally dried printed materials such as webs of paper or fabric.

Webs of paper, for example, are printed at a high speed in rotary offset printing and then they are subjected to a thermal drying process in order to dry and set the printing inks. In doing so, the printed web of paper must be moistened before the final processing in order to assure the original paper moisture content and thus the elasticity and dimensional stability of the paper required for the final processing. This is necessary because dry paper is very brittle and breaks or tears easily when folded or cut. In addition, dry paper expands when it absorbs moisture from the atmosphere, leading to unattractive waviness of finished coated newspapers, etc. and irregular "growth" of the individual pages in the cut areas.

In a known process for moistening webs of material (German patent 3,115,958 C2), a web of material is subjected to a corona treatment before a moistening agent is applied to it in a moistening station. This treatment is supposed to create a number of adhesive centers to promote adhesion of the particles of moistening agent. A moistening bath or a spray device that is not described in further detail is used as the moistening station.

With a known device for moistening moving webs of material, especially webs of paper (German patent 3,823,739 A1), one side of the web of paper is passed by a continuous belt whose top side has a conductive coating to which a high voltage is applied. To form aerosols of the moistening agent, a conductive atomizer is provided on the other side of the web of paper at some distance from it. A strong electric field is created between the atomizer and the conductive coating, causing the aerosol particles to be polarized and then accelerated so they not only wet the web of paper but also penetrate into the pores of the paper.

A disadvantage of this known device is that for a relatively high output, it is necessary to work with a high voltage in the range of 50 kV, so the moistening device is very sensitive to fluctuations in atmospheric humidity, because if the atmospheric humidity is too high, spark discharges may occur and can damage the web of paper. in addition, expensive shielding measures must be provided as a safety measure. Another disadvantage is that this known device needs a relatively large amount of space, so it cannot be added subsequently to existing printing machines or other processing machines.

With another known device (German patent 4,021,296 A1), an applicator roll that is in turn wetted by a scoop roll that dips into the moistening agent must be used to apply the moistening agent to the web of material. In order to moisten a web of material, the applicator roll is pivoted toward a web of paper or other material in such a way that it deflects the web out of its path of conveyance. As a result, the web of material moving over the applicator roll rubs off the film of moistening agent.

Since the contact between the web of material and the applicator roll is not uniform with this device, a uniform and defined application of moistening agent is impossible.

With another device for applying moistening agent to a web of material (U.S. Pat. No. A 3,066,046), an applicator roll is provided with an applicator surface that consists of a fabric with a rubber coating on the reverse side. The driven applicator roll is clamped between a scoop roll that dips into a moistening agent bath and a pressure roll. The web of material to be moistened is preferably passed through the crimping area between the pressure roll and the applicator roll.

The uptake of moistening agent by the surface of the applicator roll can be regulated by varying the pressure between the scoop roll and the applicator roll, while the amount of moistening agent that is released to the web of material can be adjusted by varying the pressure between the applicator roll and the pressure roll.

Printed and thermally dries webs of material cannot be moistened with this device because the structured surface on the applicator roll would damage the print image of the printed web of material and furthermore there is the danger that the moving web of material might tear due to the additional conveyance through the driven applicator roll.

This invention is based on the problem of providing another process and another device of the type mentioned initially with which it is possible to apply even small amounts of a moistening agent easily so the moistening agent adheres well to the web of material.

This problem is solved according to this invention by the characterizing features of patent claim 1 in a process of the aforementioned type.

Thus, according to this invention, a web of material is first dried and then wetted on at least one side with a moistening agent that is also pressed into the web at the same time. The application and pressing of the moistening agent are performed at the earliest possible time, preferably during the cooling phase—in other words, as soon as the printing ink has dried to the point that it will no longer smear when the moistening agent is pressed into the web of material and thus the possibility of a negative effect on the print image can be ruled out. When the moistening agent is applied during the cooling phase, the uptake of the moistening agent into the web of material, especially a web of paper, is supported by the cooling of the web.

The penetration of the moistening agent into the web of material can be supported significantly in an advantageous manner if the web of material is electrostatically charged in an electric high-voltage field. In particular, the film of moistening agent, which may still contain certain irregularities after being applied, is evened out in such a way that it is uniform over the entire width of the web of material and adheres well to the web of material. Consequently, this prevents small droplets of moistening agent from separating from the film of moistening agent applied to the web of material, even when the web of material—such as the web of paper in a rotary offset printing machine—is moving at a high transport speed.

This is especially advantageous in rotary offset printing, because it is necessary in that process to remoisten a printed and then dried web of paper into which the moistening agent can penetrate only relatively slowly owing to the coating with the dried and optionally quenched printing ink. As a result of the uniform distribution and adhesion of the film of moistening agent to the web of paper, the print image is not affected by the film of moistening agent and furthermore the moistening agent has enough time to penetrate through the printing ink into the web of paper.

Since the moistening takes place at a time when the printing ink has already developed a certain resistance to having the moistening agent pressed into it but has not yet reached its final strength, the moistening agent can penetrate better through the printing ink into the paper, which is still relatively warm. Consequently, the paper has an improved elasticity during the following treatment.

With the preferred embodiment according to patent claim 3, the web of material is restored to its initial moisture content during the cooling phase and thus its original elasticity is also restored. It has been found that the moistening of the paper is effectively supported by the cooling effect.

The process according to patent claim 4 is provided in order to assure satisfactory transport during and after the respective moistening process. In addition to leveling the film of moistening agent, this also has the effect that the web of material is in especially good contact with its guide devices following the moistening zone.

The design of the invention according to patent claim 5 is provided in order to apply an especially uniform film of moistening agent to the web of material.

The wetting of the web of material and the uptake of moistening agent into the web of material can be further improved by the embodiments of this invention according to patent claims 6 to 9.

In the embodiment of this invention according to patent claim 10, the electrostatic charge is produced with a high voltage of less than 50 kV. A relatively low electric power is needed, so when carried out with high voltage, no unwanted spark discharges need be feared even when there are fluctuations in atmospheric humidity. Because of the low currents needed for the electrostatic charge, only relatively simple shielding measures are necessary for the parts that carry the high voltage without endangering the safety of the maintenance personnel.

In another embodiment of this invention according to claims 11 and 12, the depth of penetration of the moistening agent can also be influenced and kept constant at a given moistening agent content. This yields a good and uniform remoistening effect.

The process according to this invention is carried out in an advantageous manner with a device according to patent claim 13.

Preliminary practical embodiments of the device according to this invention are described in patent claims 14 and 15.

The space required for the device according to this invention can be minimized with the embodiment according to patent claim 16, so this is also suitable for subsequent installation in existing machines for processing webs of material.

The embodiments of this invention according to patent claims 17 and 18 permit an especially accurate and uniform adjustment of the amount of moistening agent with regard to the size of the surface to be wetted. This is necessary especially in moistening or remoistening printed and dried webs of paper, because in such cases approx. 1.5 to 2 ml must be applied uniformly to 1 $m^2$ in order to moisten the web of material. The amount of moistening agent per unit of area must be maintained with a high degree of precision, because too much moistening agent would lead to spots or other damage to the printed surface, whereas too little moistening agent would fail to adequately eliminate the brittleness of the dried web of paper.

The uniformity of the film of moistening agent and its transfer to the surface of the web of material can be achieved especially well with the embodiments of this invention according to patent claims 19 to 24.

The embodiments according to patent claims 25 and 26 are especially suitable for regulated and/or uniform spraying of the moistening agent to form the film of moistening agent.

In an especially advantageous embodiment, a driven roll can be used as a guide element for the web of material. This device for moistening a web of material can be added on subsequently to an existing processing machine for such webs of material in an especially advantageous manner, because the guide rolls and conveyor rolls already available in such a machine can also be used for the device according to this invention.

For example, the cooling rolls over which the printed and dried web of paper is guided after drying to quench the printing ink may be used as guide elements in the device according to this invention without requiring great changes in the cooling station in order to be able to install the device according to this invention. It is also advantageous for more cooling rolls to be kept in readiness when working at high rates of conveyance of the web of material, because cooling then also requires an increased number of cooling rolls on which the devices according to this invention for moistening the web of paper could be mounted.

This invention is described in greater detail below on the basis of the examples illustrated in the figures, which show the following:

Corresponding parts in the various figures are labeled with the same numbers.

Figure 1:
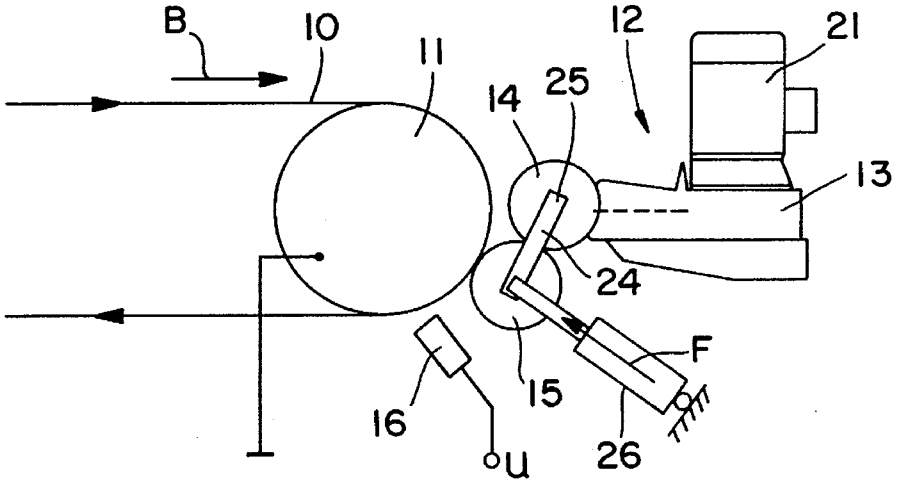
FIG. 1 shows a schematic diagram of a device for moistening a moving web of material.

As shown schematically in FIG. 1, a web of material 10 to be moistened is passed over electrically conducting roll 11, preferably a driven roll that serves as a guide element and in doing so it moves in the direction of arrow B. Radially next to roll 11 there is an applicator device 12 for applying a film of moistening agent to the web of material 10 that has a spray device 13 and a roll arrangement with a first roll 14 and a second roll 15.

Downstream from the applicator device 12 in the direction of movement B of the web of material 10 there is a charging rod 16 of a charging device that runs parallel to the longitudinal direction of the electrically conducting roll 11 and works together with the latter in the manner of a capacitor to build up an electrostatic charge in the web of material 10 after it has left the area of the applicator device for the moistening agent. For this purpose, the charging rod 16 is connected to a high-voltage source U and the electrically conducting roll 11 is connected to ground. In a preferred embodiment of the invention, charging rod 16 is positioned 20 mm to 40 mm from guide element 11.

Figure 3:
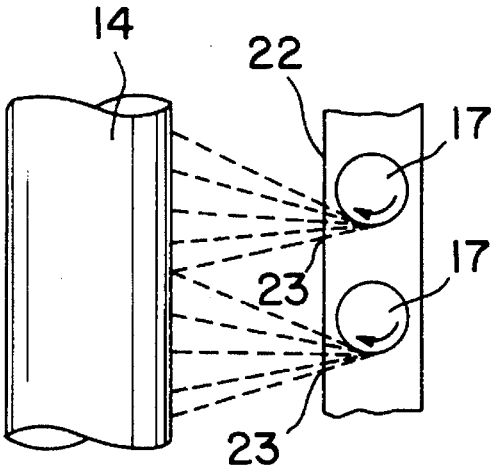
FIG. 3 is a simplified schematic diagram showing a device for spraying the moistening agent and its roll of a type like that used in the device according to FIG. 1.
Figure 4:
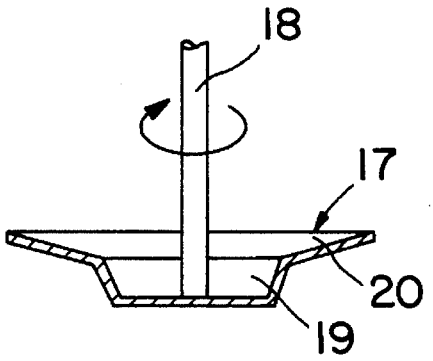
FIG. 4 shows a rotary disk for the spray device according to FIG. 3.

As indicated in FIG. 3, spray device 13 has several rotating disks 17 that are mounted side by side in a row parallel to the first roll 14. Rotating disks 17 are mounted on one end, preferably the lower end, of a drive shaft 18, as shown in FIG. 4, and they have a central pot area 19 connected to a shallow spray flange 20 that extends radially outward. To drive the rotating disks 17, the respective drive shafts 18 are connected to a motor 21 in a suitable manner that is not described in detail here.

In order to specify a defined spray area for each rotating disk 17 of the spray device 13, an orifice 22 is provided between the first roll 14 of the applicator device 12 and the rotating disks 17 that are arranged in a row. This orifice 22 has a passage 23 in the area of each rotating disk 17 for the moistening agent that is sprayed onto the first roll 14. The rotating disks with the respective orifice areas form individual sectors that are preferably controlled individually so that different sections of the web of material can be remoistened to conform to requirements as desired.

In order to assure that the moistening agent sprayed onto the first roll 14 forms the required uniform or regulated film of moistening agent on the surface of the roll, the first roll 14 is provided with a water-friendly surface—in other words, so it can be wetted well. Suitable materials for the surface of the first roll 14 include glass, ceramics and chrome, but chrome is preferred because the roll 14 must be designed to withstand extremely high peripheral velocities.

The second roll 15 which engages with the first roll 14 in order to transfer the film of moistening agent applied to the first roll 14 to the web of material 10 is mounted by means of a strap arrangement 24 so it can pivot about the longitudinal axis 25 of the roll 14 which is normal to the plane of the figure. In order to press the roll 15 that has a polished surface and is made of rubber or a rubber elastic plastic with a force F against the web of material B that is guided over roll 11, a pneumatic cylinder arrangement 26 or another suitable pressure force generating device acts on the strap arrangement 24.

The material of the rubber roll 15 has a Shore hardness of 30° to 70° Shore, especially about 50° Shore. The force F is selected so as to yield a pressure per unit of area value of about 0.9 to 2.5 $dN/cm^2$, especially 1.7 $dN/cm^2$.

Figure 5:
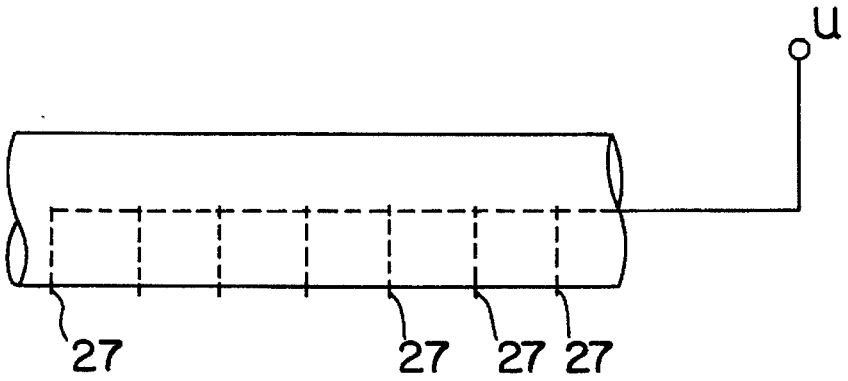
FIG. 5 shows a schematic detail of a charging rod for the device according to FIG. 1.

As shown in FIG. 5, the charging rod 16 of the charging device that runs parallel to the conducting roll 11 has several needle electrodes 27 arranged in a row with some distance between them. Needle electrodes 27 are preferably arranged in the radial direction to the roll 11 and thus at right angles to the web of the material or to a plane tangential to the web of material.

A moving web of material is moistened with the device described here as follows:

First, a moistening agent such as plain water or water mixed with surfactants or other chemicals and heated to a constant temperature is sent to the pot area 19 of the rotating disks 17 of the applicator device 13. For spraying drops of moistening agent, the rotating disk 17 is rotated at a high speed, such as 5000 rpm for a disk diameter of about 80 min. Due to the resulting high peripheral velocity, droplets of moisture or aerosols with a diameter of about 50 to 75 μm, preferably 60 to 65 μm, depending on the surface tension of the moistening agent and the wettability of the material of which the rotating disk is made, are thrown from the edge of the rotating disk. These aerosol particles are sprayed onto the first roll 14 where they form a film of moistening agent that can be regulated accurately and transferred from the second roll 15 and applied to the web of material 10 moving around the conducting roll 11. In the transfer of the film of moistening agent from the rubber-elastic roll 15 to the web of material 10, the film of moistening agent is distributed between the web of material 10 and the roll 15. After moistening or wetting the web of material 10 with moistening agent, the web of material 10 passes beneath the charging rod 16, so the wetted web of material 10 is charged.

This electrostatic charge first causes the wetted web of material 10 to cling tightly and smoothly to the conducting roll 11. At the same time, the electrostatic charge has the effect of leveling the film of moistening agent applied to the web of material 10 so the film of moistening agent adheres reliably to the web of material even at high transport speeds thereof and can penetrate uniformly into the web of material.

In an especially advantageous manner, the device described here can be used for remoistening a printed web of paper in rotary offset printing.

In rotary offset printing, a continuous web of paper is drawn off from supply rolls at very high speeds, for example, at speeds in the range of 5–8 m/s and printed by four-color printing in four successive printing units. Then the printed web of paper is dried in a drying station at temperatures of about 200° C. to set the printing inks so they cannot be damaged in the subsequent processing step. This drying process is followed by cooling of the printed web of paper in order to quench the heated and dried printing inks. However, the web of paper dries out as a result of the drying process used to dry the printing inks, so paper has a low residual moisture content of only about 3–5% after drying.

Due to this extremely low residual moisture content of the paper, the web of paper becomes relatively brittle, so it is difficult to process in the subsequent operations such as folding, cutting and stapling and tends to be damaged easily. In addition, uncontrolled changes occur in the dimensions of the web of paper processed when the paper absorbs moisture again from the atmosphere after the final processing steps. This leads to low-quality or unattractive print products.

Figure 2:
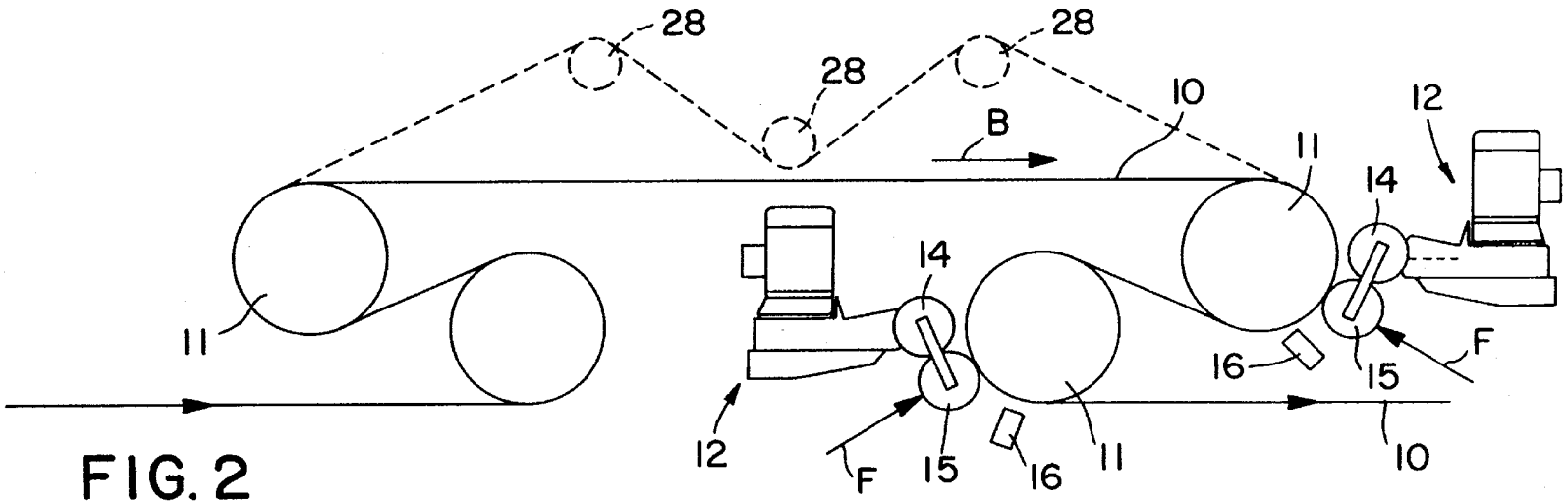
FIG. 2 shows a simplified schematic diagram of a cooling roll arrangement of a rotary offset printing machine with the devices arranged on it according to FIG. 1.

In order to restore the original moisture content of the printed and dried web of paper before final processing, the device described with reference to FIG. 1 for moistening a moving web of material can be arranged in a cooling station as part of a rotary offset printing machine. For this purpose, as shown in FIG. 2, applicator devices 12 for applying moistening agent are mounted on at least one or preferably two or more cooling rolls 11 in a cooling station in a printing machine (only the first four cooling rolls 11 of a total of eight cooling rolls, for example, are shown here). When using two applicator devices 12 for moistening agent, the two applicator devices are provided with two cooling rolls, each off which induces an opposite deflection of the web of paper 10, so the two surfaces of the web of paper 10 are moistened one after the other.

Figure 6:
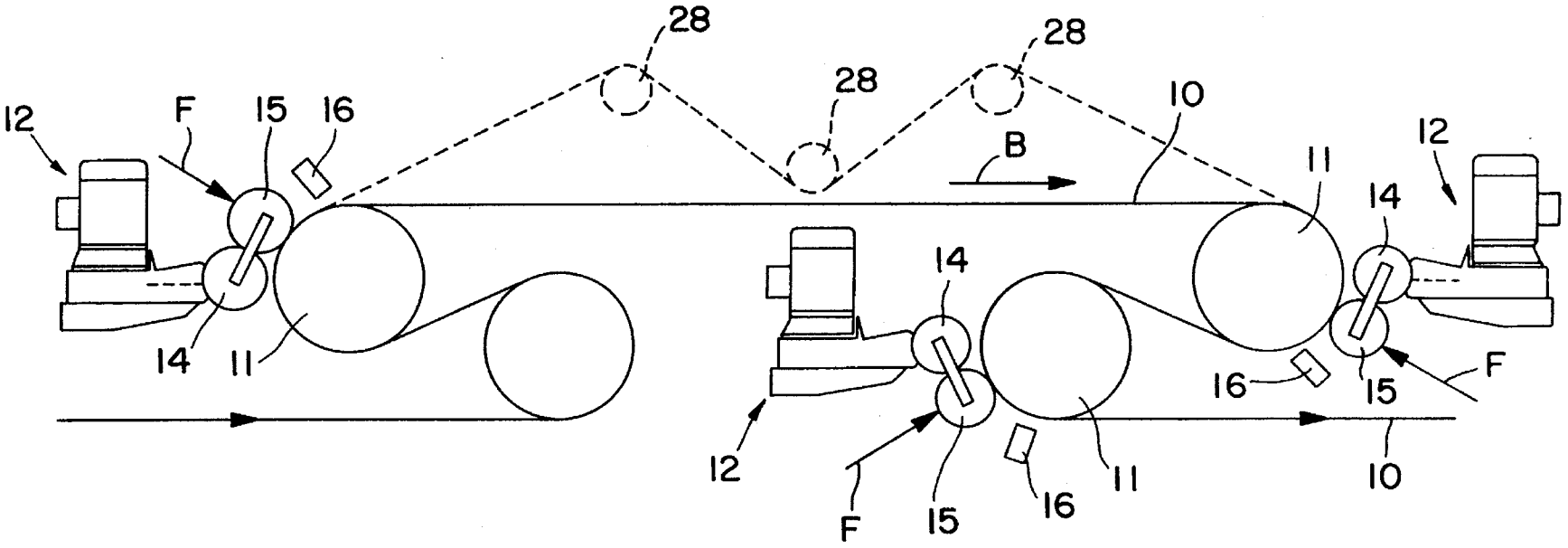
FIG. 6 shows a simplified schematic diagram of a cooling roll arrangement of a rotary offset printing machine according to an alternative embodiment of the invention.

The applicator devices 12 are preferably mounted on the cooling rolls 11 at the inlet end of the machine in order to achieve remoistening of the web of paper as soon as possible after drying. In a cooling station with four cooling rolls, for example, the first applicator device may be mounted on the second cooling roll 11, for example, as shown in FIG. 6, wherein like elements to those illustrated in FIG. 2 are provided with like reference numerals.

Mounting the applicator devices 12 at the inlet end permits an additional cooling of the printed web of material by using a moistening agent that is regulated at a constant temperature that is lower that the temperature of the web of paper in this area, such as 15° C.

In order to prevent uncontrolled changes in the dimensions of the web of paper 10, especially in the direction of width, after moistening, width-adjusted expanding rolls 28 can be provided downstream from applicator device 12 in order to prevent shrinkage of the web of paper in the transverse direction.

Although no such expanding rolls are shown in FIG. 2 downstream from the last cooling roll 11 shown there in the direction of movement b of the web of paper 10, they can also be used here as needed.

An important advantage of the device described here consists of the fact that it can be installed without much expense in a finished cooling station, where the cooling rolls 11 can be used as the conducting rolls that work together with the charging rod 16 and the second roll 15 of the roll arrangement.

We claim:

1. A process for moistening a moving web of material, having two opposed sides, especially for remoistening a printed and thermally dried web of printed material, where a moistening agent is applied to the web of material, comprising the steps of:

cooling the web following the thermal drying by, in part, passing the web of material onto a cooled guide element (11) with one of the sides of the web of material in contact with the cooled guide element;

wetting at least one of the sides of the web by:

supplying a metered amount of a moistening agent onto one roll (15); and at a point at which the web contacts the cooled guide element, pressing the one roll (15) with a predetermined amount of force against the side of the web of material opposed to the one side in contact with the cooled guide element (11) to apply the metered amount of moistening agent to the web of material (10) while the web is still substantially hot and dry.

2. The process according to claim 1, further comprising the step of passing the web through a high-voltage electric field so that the web becomes electrostatically charged, after the web has been wetted with the moistening agent.

3. A process according to claim 2, characterized in that the electrostatic charge is applied with a high voltage in the range of ±10 kV to about ±45 kV, respectively.

4. The process according to claim 1, further comprising the steps of:

guiding the web over an electrically conducting guide element; and electrostatically charging the web prior to separation of the web from the electrically conducting guide element.

5. The process according to claim 1, wherein the step of wetting at least one side of the web further comprises the steps of:

spraying the moistening agent onto another roll to form a film of moistening agent; and transferring the film of moistening agent from the another roll to the one roll by roller application; and transferring the film of moistening agent from the first roll to the web of material by roller application.

6. The process according to claim 1, wherein the step of wetting the web of material with the moistening agent further comprises the steps of wetting the two sides of the web of material in successive wetting operations.

7. The process according to claim 1, characterized in that moistening agent is applied to the web of material (10) in several steps in succession.

8. The process according to claim 1, wherein the step of wetting the web with a moistening agent further comprises the step of wetting the web with pure water.

9. A process according to claim 8, wherein the step of wetting the web with moistening agent further comprises the step of wetting the web with water to which surfactants have been added.

10. The process according to claim 9, wherein the step of wetting the web with moistening agent further comprises the step of wetting the web with water to which has been added chemicals that influence at least one of the properties from the group consisting of: the surface tension of the water, the diffusion properties of the water, the electric properties of the water.

11. A process according to claim 1, characterized in that the moistening agent is kept at a constant temperature before being applied to the web of material (10).

12. A process according to claim 11, characterized in that the moistening agent is kept at a temperature between 15° C. and 50° C.

13. The process according to claim 1, wherein the step of wetting the web with a moistening agent further comprises the step of wetting the web with water mixed with additives.

14. A process according to claim 13, wherein the step of wetting the web with moistening agent further comprises the step of wetting the web with water to which surfactants have been added.

15. The process according to claim 13, wherein the step of wetting the web with moistening agent further comprises the step of wetting the web with water to which has been added chemicals that influence at least one of the properties from the group consisting of: the surface tension of the water, the diffusion properties of the water, the electric properties of the water.

16. A device for remoistening a web of material which has been printed and thereafter thermally dried so as to be substantially hot and dry immediately after the drying, and having an applicator device (12) for applying a moistening agent to the web of material, characterized in that the applicator device (12) has a roll arrangement with at least one roll which is in rolling contact with the web, and further characterized by:

a spray applicator device (13) for applying the film of moistening agent to the at least one roll, at least indirectly, by spraying the moistening agent in a metered amount;

a guide element (11) for guiding the web while the at least one roll is transferring the moistening agent directly to the web, the guide element being further operably configured to substantially simultaneously cool the side of the web opposite the at least one roll; and means for pressing the at least one roll (15) against the web with a predetermined amount of pressure at a point where the web is carried by said guide element, the device being further configured so that the moistening agent is applied to the web, while the web is still substantially hot and dry following the thermal drying.

17. The device according to claim 16, characterized in that a charging device for charging the web of material (10) that has been wetted with the moistening agent is arranged downstream from the applicator device (12) in the direction of movement (B) of the web of material (10).

18. The device according to claim 17, characterized in that the charging device has a charging rod (16) connected to a high-voltage source (U) that has several spaced apart needle electrodes (27) arranged so that they are at right angles to the web of material (10).

19. The device according to claim 17, characterized in that the charging device has a charging electrode arrangement (16, 27) that is connected to a high-voltage source (U) and is positioned opposed the wetted surface of the web of material (10) and works together with an electrically conducting guide element (11) that is connected to ground.

20. The device according to claim 19, characterized in that the charging electrode arrangement (16, 27) is arranged at a distance of 20 mm to 40 mm from the guide element (11).

21. The device according to claim 16, characterized in that the at least one roll (14) has a hydrophilic surface.

22. The device according to claim 16, characterized in that the at least one roll (14) has a surface consisting of one of the following materials: ceramic, chrome.

23. The device according to claim 16, characterized in that the guide element is configured to be a driven cooling roll.

24. The device according to claim 16, characterized in that the device further includes another roll (14) which engages with rolling contact the at least one roll (15), and the moistening agent is applied by spraying by the spraying device (13) against the another roll and transferred from the another roll (14) to the at least one roll (15) by rolling contact.

25. The device according to claim 24, characterized in that the at least one second roll (15) is pressed to the surface of the web of material in the area of the guide element (11) so that a surface pressure in the range of 1.4 $dN/cm^2$ to 2.0 $dN/cm^2$, is exerted on the web.

26. The device according to claim 24, characterized in that the at least one roll (15) is pressed to the surface of the web of material in the area of the guide element (11) so that a surface pressure of 1.7 $dM/cm^2$, is exerted on the web.

27. The device according to claim 16, characterized in that the another roll (15) has a surface consisting of one of the following materials:

rubber, resilient plastic material.

28. The device according to claim 27, characterized in that the Shore hardness of the another roll (15) is between 30° and 70° Shore.

29. The device according to claim 27, characterized in that the Shore hardness of the at least one roll (15) is 50° Shore.

30. The device according to claim 27, characterized in that the Shore hardness of the at least one roll (15) is between 45° and 55° Shore.

31. The device according to claim 30, characterized in that the another roll (15) is pressed to the surface of the web of material in the area of the guide element (11) so that a surface pressure in the range of 0.9 $dN/cm^2$ to 2.5 $dN/cm^2$, is exerted on the web.

32. The device according to claim 30, characterized in that the rolls (14, 15) of the roll arrangement have polished surfaces.

33. The device according to claim 30, characterized in that the moistening agent spray device (13) has individual sectors distributed over the width of the web of material that can be controlled individually.

34. The device according to claim 30, characterized in that a rotary disk spray device is provided as the spray device for the moistening agent.

* * * * *